US005468714A

United States Patent [19]

Oshima et al.

[11] Patent Number: 5,468,714

[45] Date of Patent: Nov. 21, 1995

[54] HEAT TRANSFER SHEET

[75] Inventors: Katsuyuki Oshima; Masaki Kutsukake; Hideaki Sato; Kenichiro Sudo, all of Tokyo, Japan

[73] Assignee: Dai Nippon Insatsu Kabushiki Kaisha, Japan

[21] Appl. No.: 188,735

[22] Filed: Jan. 31, 1994

Related U.S. Application Data

[63] Continuation of Ser. No. 5,089, Jan. 15, 1993, abandoned, which is a continuation of Ser. No. 625,660, Dec. 12, 1990, Pat. No. 5,217,942.

[30] Foreign Application Priority Data

Dec. 15, 1989 [JP] Japan ..... 1-323892
Dec. 15, 1989 [JP] Japan ..... 1-323893

[51] Int. Cl.[6] ..... B41M 5/035; B41M 5/38

[52] U.S. Cl. ..... 503/227; 428/195; 428/212; 428/412; 428/447; 428/500; 428/522; 428/913; 428/914

[58] Field of Search ..... 8/471; 428/195, 428/212, 913, 914, 412, 447, 500, 522; 503/227

[56] References Cited

U.S. PATENT DOCUMENTS

| | | | |
|---|---|---|---|
| 4,465,728 | 8/1984 | Haigh et al. | 428/156 |
| 4,738,949 | 4/1988 | Sethi et al. | 503/227 |
| 4,880,768 | 11/1989 | Mochizuki et al. | 503/227 |
| 5,043,318 | 8/1991 | Kawakami et al. | 503/227 |
| 5,063,198 | 11/1991 | Imai et al. | 503/227 |
| 5,118,657 | 6/1992 | Kawakami et al. | 503/227 |
| 5,144,334 | 9/1992 | Suzuki et al. | 346/1.1 |

FOREIGN PATENT DOCUMENTS

| | | | |
|---|---|---|---|
| 0361552 | 4/1990 | European Pat. Off. | 503/227 |
| 2-141289 | 5/1990 | Japan | 503/227 |

*Primary Examiner*—B. Hamilton Hess
*Attorney, Agent, or Firm*—Parhurst Wendel & Rossi

[57] ABSTRACT

A heat transfer sheet having improved releasability includes a substrate film and a dye layer system formed on the substrate film. The dye layer system is composed of a dye allowed to migrate and transfer thermally onto an image-receiving sheet and a binder, wherein the dye layer system comprises two layers, only the outer surface layer of which contains a slip agent and/or a releasant.

10 Claims, No Drawings

HEAT TRANSFER SHEET

This is a division of application Ser. No. 08/005,089 filed Jan. 15, 1993, now abandoned, which is a continuation of Ser. No. 07/625,660, filed Dec. 12, 1990, now U.S. Pat. No. 5,217,942.

BACKGROUND OF THE INVENTION

The present invention relates to a heat transfer sheet and, more particularly, to a heat transfer sheet which is useful for heat transfer systems using sublimable (or thermally migrating) dyes. The dye layer of the heat transfer sheet is easily releasable from an associated image-receiving sheet at the time of heat transfer. The heat transfer sheet provides a monochromic or full-color image excelling not only in image density but also in light fastness. The present invention also relates to a heat transfer process.

As replacements to generally available typographic and printing techniques, ink jet, heat transfer and other systems have been developed to provide excellent monochromic or full-color images in a simple and fast manner. The most excellent of all is the so-called sublimation heat transfer system making use of a sublimable dye, which provides a full-color image having an improved gradation or gray scale and comparable to a color photograph.

In general, a heat transfer sheet used with the sublimation type of transfer system typically includes a substrate film such as a polyester film, which is provided on one side with a dye layer containing a sublimable dye and on the other side with a heat-resistant layer for preventing it from sticking to a thermal head.

The dye layer of such a heat transfer sheet is overlaid on an associated image-receiving material having an image-receiving layer formed of polyester or other resin, and heat is applied to the heat transfer sheet from its backside in an imagewise manner, thereby causing migration of the dye through the dye layer to migrate onto the image-receiving sheet to form the desired image.

With the above-mentioned heat transfer system wherein a very quick heat transfer is needed, it is required to operate a thermal head at elevated temperatures, because heating by the thermal head must occur within a very short span of time (of the order of msec.). Increasing the thermal head temperature, however, results in a binder forming part of the dye layer being so softened that it sticks to the image-receiving sheet, leaving the heat transfer sheet bonded to the image-receiving sheet or, in the worst case, gives rise to a so-called unusual transfer problem in which the dye layer separates off and passes immediately onto the surface of the image-receiving sheet during releasing.

In order to provide a solution to the aforesaid problem, it has been proposed to add a slip agent and/or a releasant to the dye layers of image-receiving sheets (see U.S. Pat. No. 4,740,496 specification). However, this method sustains a drop of dye receptivity, and makes it difficult to laminate and bond a surface protecting layer such as a transparent film onto the resulting image, if it is needed.

In order to solve such a problem, it has been proposed to incorporate a slip agent and/or a releasant in the dye layers of heat transfer sheets without adding them to the dye-receiving layers of associated image-receiving sheets or with, if added, reducing their amount. With this method, however, substrate films tend to repel a dye layer forming-coating solution during the formation of dye layers, rendering it difficult to make them uniform and hence presenting a color shading problem to the resulting images. Moreover, the formed dye layers have such poor adhesion to the substrate films that the so-called unusual transfer is likely to occur, thus making the dye layers themselves separate off and pass onto the associated image-receiving sheets.

It is, therefore, a primary object of this invention to provide a heat transfer sheet enabling an image of better quality to be given without offering such problems as above mentioned.

On the other hand, there have heretofore been known various heat transfer techniques inclusive of a sublimation heat transfer technique in which a sublimable dye is carried on a substrate sheet, e.g., paper as a recording medium to form a heat transfer sheet. The heat transfer sheet is then overlaid on an image-receiving material, which is dyeable with the sublimable dye, e.g. an image-receiving sheet obtained by forming a dye-receiving layer on paper, plastic film or the like, thereby making various full-color images thereon.

The heating means used for this purpose is a printer's thermal head which can transfer a number of color dots of three or four colors onto the image-receiving material by very quick heating, thereby reconstructing a full-color image representation of the original image with the multicolor dots.

The thus formed image is very clear and excels in transparency due to the coloring material used being a dye, so that it can be improved in terms of the reproducibility of neutral tints and gray scale. Thus, it is possible to form a high-quality image equivalent to an image achieved by conventional offset or gravure printing and comparable to a full-color photographic image.

However, a problem with that heat transfer technique is that the resulting images are generally so inferior in light fastness to pigmentated images that they fade away or discolor prematurely when exposed directly to sunlight. Another problem is that even when they are placed in places upon which light does not strike, e.g. placed indoors or put in files or books, they tend to discolor or fade away. It has been known as a partial solution to such problems in connection with light fastness and fading in the dark by adding ultraviolet absorbers or antioxidants to the dye-receiving layers of image-receiving sheets.

With the sublimation type of heat transfer technique wherein the antioxidant, etc. are distributed uniformly over the dye-receiving layer while a large part of the dye transferred is present in the vicinity of the surface of the dye-receiving layer, however, it is impossible to provide efficient protection to the dye and so prevent discoloration and fading sufficiently. Thus, a technique enabling the dye transferred to be effectively protected by antioxidants, etc. has been in great demand.

In order to eliminate such a problem, the inventors have already proposed to incorporate an ultraviolet absorber, etc. in the dye layer of a heat transfer sheet, rather than in an image-receiving layer, and transferring the ultraviolet absorber, etc. onto an imaging region simultaneously with the transfer of the dye (see Japanese Patent Application No. Sho. 63-290101 specification).

Although such a method has been found to have some effects, however, it is not always well fit for forming a color image by repeating a plurality of transfer cycles at the same region of an image-receiving sheet. The reason for this would be that the ultraviolet absorber, etc. transferred with the dye at an initial or early stage of transfer is so caused to penetrate deeply through the dye-receiving layer by heating at a later stage of transfer that their concentration can become insufficient on the surface of the dye-receiving layer on which an actual image is to be formed.

It is, therefore, another object of this invention to provide a heat transfer sheet or process best suited for use with the heat transfer technique making use of sublimable dyes, which can provide clear images of sufficient density and having far more improved fastness properties, esp. light fastness and resistance to fading in dark places.

SUMMARY OF THE INVENTION

The first aspect of this invention concerns a heat transfer sheet having improved releasability, which includes a substrate film and a dye layer system formed on said substrate film, said dye layer system being composed of a dye allowed to migrate and transfer thermally onto an image-receiving sheet and a binder, wherein:

said dye layer system comprises two layers, only the outer surface layer of which contains a slip agent and/or a releasant.

With the heat transfer sheet according to the first aspect of this invention wherein the dye layer system thereon comprises two layers, only the surface dye layer of which contains a slip agent and/or a releasant (hereinafter called the releasant, etc.), it is possible to make the dye layer system uniform without presenting a repellency problem during the application of a dye layer-forming coating solution, improve the releasability of the dye layer system from an associated image-receiving sheet without suffering from anything unusual at the time of heat transfer and provide a transfer image of high quality.

The second aspect of this invention comprises two facts, one concerning a heat transfer sheet including a substrate film and a plurality of color dye layers formed on one surface of said substrate film, wherein the dye layer of said dye layers to be finally transferred contains a dye stabilizer therein or thereon; and the other directing to a heat transfer process involving overlaying a dye-receiving layer of an image-receiving sheet including a substrate film having said receiving layer with a dye layer system of a heat transfer sheet including a substrate film having said layer system in opposite relation and applying heat to said heat transfer sheet from its backside to repeat a plurality of transfer cycles, thereby forming a color image, wherein a dye stabilizer is transferred onto an imaging region simultaneously with or after the final transfer cycle.

According to the heat transfer process for forming a color image by repeating a plurality of transfer cycles wherein a dye stabilizer is incorporated in only the dye layer to be finally used or a stabilizer-containing layer is formed on the surface of that dye layer and the dye stabilizer is transferred onto the imaging region simultaneously with or after the transfer of the final dye.

ILLUSTRATIVE EXPLANATION OF THE INVENTION

The first aspect of this invention will now be explained in greater detail with reference to its preferred embodiments.

The heat transfer sheet according to the first aspect of this invention, which is basically obtained by forming a dye layer system on a substrate film, as is the case with the prior art, is characterized in that said dye layer system comprises two layers, only the surface dye layer of which contains a release agent.

For the substrate film of the heat transfer sheet according to this invention, use may be made of any film so far known to have some heat resistance and strength. Mention, for instance, is made of paper, various forms of processed paper, polyester films, polystyrene films, polypropylene films, polysulfone films, aramid films, polycarbonate films, polyvinyl alcohol films and cellophane, all having a thickness of 0.5 to 50 μm, preferably 3 to 10 μm. Particular preference, however, is given to the polyester films. These substrate films may be in a continuous or discontinuous form, although not limited thereto.

No particular limitation is imposed upon the dyes used in this invention. All dyes so far used with conventional known heat transfer sheets may be effectively used in this invention. Mention, for instance, is made of red dyes such as MS Red G, Macrolex Red Violet R, Ceres Red 7 B, Samaron Red HBSL and Resolin Red F3BS; yellow dyes such as Foron Brilliant Yellow 6GL, PTY-52 and Macrolex Yellow 6 G; and blue dyes such as Kayaset Blue, Vacsolin Blue AP-FW, Foron Brilliant Blue S-R and MS Blue 100.

As the binder resins to carry such dyes as mentioned above, use may be made of all resins so far known in the art. Preference is given to cellulosic resins such as ethyl cellulose, hydroxyethyl cellulose, ethylhydroxy cellulose, hydroxypropyl cellulose, methyl cellulose, cellulose butyrate and cellulose acetate butyrate; vinylic resins such as polyvinyl alcohol, polyvinyl acetate, polyvinyl butyral, polyvinyl acetal, polyvinyl pyrrolidone and polyacrylamide; polyesters; and so on. Among others, however, preference is given to the cellulosic, acetal, butyral and polyester resins with heat resistance, resin migration, etc. in mind.

In this invention, the aforesaid dye is formed into two layers, the surface (or outermost) layer of which contains a release agent, etc.

Alternatively, a releasable polymer may be used as the binder resin. In this case, it is not necessary to add any special releasant to that polymer. Preferably, this resin should be a polymer obtained by grafting a siloxane or fluorine chain on such resins as so far mentioned. As the releasable segments to be grafted on the major chain, preference is given to polysiloxane, fluorocarbon, long-chain alkyl or like segments.

Usable as the aforesaid release agents, etc. are all releasants, etc. which have so far been used for release sheets, etc. and known to give no impediment to the thermal migration of dyes through dye layers. The releasants, etc., which give no impediment to the thermal migration of dyes through dye layers, may be easily chosen and used by subjecting to heat transfer tests various heat transfer sheets prepared with a variety of releasants, etc.

Preferably usable in this invention are compounds based on silicone, surfactants based on phosphates, waxes and so on. The silicone compounds, for instance, may include silicone alkyd, silicone grafted polymers (acrylic, polyester, styrene, urethane, butyral and acetal resins), alkyl-modified silicone, fluorine fatty acid-modified silicone, phenyl group-containing silicone, fatty acid-modified silicone and polyether-modified silicone; however, particular preference is given to the silicone grafted polymers. For instance, the phosphate type compounds may include sodium salts of phosphoric esters and the waxes polyethylene wax and carnauba wax.

Preferably, the amount of the releasant, etc. to be incorporated in the surface dye layer should lie in the range of 0.1% by weight to 30% by weight, particularly 0.1% by weight to 20% by weight.

If required, the surface dye layer may additionally contain various additives, as is the case with the prior art.

The rest of the above two layers, i.e. the dye layer free from the releasant, etc. may preferably be formed by dissolving or dispersing in a suitable solvent the aforesaid sublimable dye and binder resin as well as other desired components to prepare a coating solution or ink for forming the dye layer and then applying and drying it on the substrate film. On the other hand, the dye layer containing the releasant, etc. may be obtained by adding the releasant, etc. to a similar coating solution in like manners.

The overall thickness of the thus formed dye layers lies in the range of 0.2 to 5.0 μm, preferably 0.4 to 2.0 μm, with each dye layer being capable of amounting to 10 to 90% by weight of that overall thickness. Also, the sublimable dye may account for 5 to 90% by weight, preferably 10 to 70% by weight of the overall dye layers.

When the desired image is monochromic, one dye may be selected from the aforesaid dyes to form a monochromic dye layer. When the desired image is full-colored, on the other hand, suitable cyan, magenta and yellow (if required, black) dyes may be selected to form a dye layer system of yellow, magenta and cyan (if required, black).

As the image-receiving sheet used with such a heat transfer sheet as mentioned above to form an image, use may be made of any sheet material with its recording side having dye receptivity. When formed of paper, metal, glass or synthetic resin having no dye-receptivity, it may be provided with a dye-receiving layer on at least one side.

To this end use may also be made of resin substrates of dye receptivity such as vinyl chloride, polycarbonate and ABS (acrylonitrile-butadiene-styrene) resins, which are capable of serving well as dye-receiving layers. These substrates may be used for, e.g. various bank, credit and ID cards. Using the heat transfer sheets according to this invention in combination with such substrates could produce a particularly beneficial effect.

As means for applying heat energy used for carrying out heat transfer with such heat transfer sheets and image-receiving sheets as mentioned above, all applicator means so far known in the art may be used. For instance, the desired image may be obtained by applying a heat energy of about 5–100 mJ/mm$^2$ for a controlled time with recording hardware such as a thermal printer (e.g. Video Printer VY-100 made by Hitachi, Ltd.).

According to the first aspect of this invention in which, as so far described, a substrate film is provided thereon with two dye layers, only the surface dye layer of which contains a releasant, etc., it is possible to provide a heat transfer sheet which includes a uniform dye layer system with no fear of presenting a repellency problem during the application of a dye layer-forming coating solution and enables the releasability of the dye layer system from an associated image-receiving sheet to be improved without suffering from anything unusual during heat transfer, so that a transferred image of high quality can be obtained.

Another aspect of this invention will now be explained in greater detail with reference to its preferred embodiments.

According to the second aspect of this invention, there is provided a heat transfer sheet including a substrate film and dye layers of at least two different colors formed successively on one side of the substrate film, characterized in that the dye layer to be finally transferred contains a dye stabilizer or has a layer of said stabilizer thereon. For example, when the dye layer system comprises three layers of yellow, magenta and cyan colors transferred in that order, the stabilizer is incorporated in the cyan layer alone. This invention also embraces an alternative embodiment in which a (dye-free) stabilizer layer is provided in addition to the dye layers of three colors. In the present disclosure, the dye layer shall be understood to include such an additional stabilizer layer for the sake of convenience. As a matter of course, it is the stabilizer layer which is to be finally transferred,.

For the substrate film of the heat transfer sheet according to the second aspect of this invention, use may be made of any film so far known to have some heat resistance and strength. Illustrative mention is made of paper, various forms of processed paper, polyester films, polystyrene films, polypropylene films, polysulfone films, aramid films, polycarbonate films, polyvinyl alcohol films and cellophane, all having a thickness of 0.5 to 50 μm, preferably 3 to 10 μm. Particular preference, however, is given to the polyester films.

If such substrate films have poor adhesion to dye layers formed on their surfaces, they are preferably treated on their surfaces with primers or by corona discharge.

The sublimable (or thermally migrating) dye layers to be formed on the substrate film are obtained by carrying on it at least two dyes of different hues selected from the following dyes with suitable binder resins.

No particular limitation is imposed upon the dyes used for the second aspect of this invention. All dyes so far used for conventional known heat transfer sheets may be effectively used in this invention. Illustrative mention is made of magenta dyes such as MS Red G, Macrolex Red Violet R, Ceres Red 7B, Samaron Red HBSL and Resolin Red F3BS; yellow dyes such as Foron Brilliant Yellow 6GL, PTY-52 and Macrolex Yellow 6G; and cyan dyes such as Kayaset Blue, Vacsolin Blue AP-FW, Foron Brilliant Blue S-R and MS Blue 100.

As the binder resins to carry such thermally migrating dyes as mentioned above, use may be made of all resins so far known in the art. Preference is given to cellulosic resins such as ethyl cellulose, hydroxyethyl cellulose, ethylhydroxy cellulose, hydroxypropyl cellulose, methyl cellulose, cellulose butyrate, and cellulose acetate butyrate; vinylic resins such as polyvinyl alcohol, polyvinyl acetate, polyvinyl butyral, polyvinyl acetal, polyvinyl pyrrolidone and polyacrylamide; polyesters; and so on. Among others, however, preference is given to the cellulosic, acetal, butyral and polyester resins with heat resistance, resin migration, etc. in mind.

By the term "stabilizer" hereinafter described are meant chemicals capable of absorbing or cutting off effects bringing about changes in quality or decomposition of dyes such as those of light energy, heat energy and oxidation, thereby preventing changes in quality or decomposition of the dyes. By way of example, antioxidants, ultraviolet absorbers and light stabilizers so far known as additives for synthetic resins are referred to.

The antioxidants used, for instance, include primary ones based on phenols, monophenols, bisphenols and amines and secondary ones based on sulfur and phosphoric acid. More illustrative mention is made of commercially available products such as Sumilizer BBN-S, Sumilizer BHT, Sumilizer GM, Sumilizer MS and Sumilizer TPP-R made by Sumitomo Chemical Co., Ltd.; Yoshinox 425 and Yoshinox SR made by Yoshitomi Seiyaku K. K.; Irganox-1081 and Irganox-1222 made by Ciba Geigy AG; and Mark AO-40 made by Adekagas K. K., which are all usable in this invention.

The ultraviolet absorbers used, for instance, may be those based on salicylic acid, benzophenones, benzotriazoles and cyano acrylates. More illustrative mention is made of commercially available products such as Tinuvin P. Tinuvin 234, Tinuvin 320, Tinuvin 326, Tinuvin 327 and Tinuvin 327 made by Ciba Geigy AG; Sumisorb 110 and Sumisorb 140 made by Sumitomo Chemical Co., Ltd.; Kemisorb 10, Kemisorb 11, Kemisorb 12 and Kemisorb 13 made by Kemipuro Kasei K. K.; Uvinul X-19 and Uvinul Ms-40 made by BASF Co., Ltd.; Tomisorb 100 and Tomisorb 600 made by Yoshitomi Seiyaku K. K.; Viosorb-80 and Viosorb-90 made by Kyodo Yakuhin K. K., which are all usable in this invention.

The light stabilizers used, for instance, may be based on hindered amines. More illustrative reference is made to commercially available products such as Sanol LS-770, Sanol LS-765 and Sanol LS-774 made by Sankyo Co., Ltd.; and Sumisorb TM-061 made by Sumitomo Chemical Co., Ltd., which are all usable in this invention.

Preferably, such stabilizers have as much heat transfer (thermal migration) as the sublimable dyes or, in other words, are free from any carboxyl, sulfone or like group and have a molecular weight of 500 or less. At a molecular weight exceeding 500 transfer may become insufficient.

As so far explained, such stabilizers have to be incorporated in only the final dye layer to be heat transferred, rather than in all the dye layers involved. Studies of the inventors have indicated that an effect obtained by adding an amount of the stabilizer to the final dye layer is nearly similar to that obtained when the same amount of the stabilizer has been added to each of all the dye layers. Hence, the amount of the stabilizer to be used is reduced to ½ to ¼ as a whole. This also helps eliminate another problem with using the stabilizer in too large an amount, e.g. a blurry hue of the resulting image.

It is noted that the aforesaid stabilizers may be used alone or in admixture in an amount lying in the range of 10 to 100 parts by weight per 100 parts by weight of the dyes. In too small an amount they fail to produce sufficient effects on stabilizing the dyes, whereas in too large an amount they present such problems as a drop of dye migration.

The dye layer system according to the second aspect of this invention, which are basically constructed from the aforesaid materials, may include various additives conventionally used, as occasion demands.

Such a dye layer system may be formed by dissolving or dispersing in a suitable solvent the aforesaid sublimable dye, stabilizer (for the final dye layer alone) and binder resin as well as other desired components to prepare a coating solution or ink for forming the dye layer system and then applying and drying it on the aforesaid substrate film.

The thus formed dye layer system has a thickness lying in the range of 0.2 to 5.0 μm, preferably 0.4 to 2.0 μm. Preferably, the sublimable dye should account for 5 to 90% by weight, particularly 10 to 70% by weight of the dye layer system.

In an alternative embodiment of the second aspect of this invention, the stabilizer layer is formed on, rather than incorporated in, the surface of the outermost dye layer. In a further embodiment, a plurality of stabilizers may be located adjacent to a plurality of dye layers.

A thin film of the aforesaid stabilizer may be formed by coating a solution of it in a solvent on the surface of the dye layer or substrate film, followed by drying. Alternatively or more preferably, a solution of the stabilizer dissolved together with the aforesaid binder in a solvent is coated on the surface of the dye layer or substrate film, followed by drying. Although not critical, the stabilizer and binder should generally be used at a weight ratio of about 1:1 to 10:1. Also, the thickness of the layer formed is generally in the range of about 0.05 to 10 μm. At too small a thickness they fail to produce sufficient effects upon stabilizing the transferred dye, whereas at too large a thickness they have a detrimental effect on dye transfer.

It is noted that the heat transfer sheet according to the second aspect of this invention may be provided on its backside with a heat-resistant layer for preventing the heat of a thermal head from producing an adverse influence on it.

For an image-receiving sheet used to form an image in association with the heat transfer sheet according to the second aspect of this invention, any material having its recording surface possessing dye receptivity may be used. In the case of films or sheets free from dye receptivity such as those made of paper, metal, glass or synthetic resin, however, they may be provided on at least one surface with a dye-receiving layer of a resin having improved dye receptivity. Preferably, such a dye-receiving layer contains as releasants solid waxes such as polyethylene wax, amide wax and Teflon powders; surface active agents based on fluorine and phosphates; silicone oils; and the like, all known in the art.

In accordance with one embodiment of the heat transfer process of this invention wherein the heat transfer sheet according to the second aspect of this invention is used, a plurality of transfer cycles are repeated with dye layers of different hues to form a color image through color mixing. In this embodiment, the stabilizer is transferred onto a dye transfer (or imaging) region simultaneously with or after the transfer of the final dye, the former or latter for the dye layer including the stabilizer therein or thereon.

In accordance with another embodiment of the transfer process of this invention, a plurality of monochromic heat transfer sheets are used to form a color image. In this embodiment, the stabilizer may be incorporated in the dye layer of the heat transfer sheet to be finally transferred. More preferably, an image is first formed with a plurality of monochromic heat transfer sheets in such a manner as mentioned above. Then, a separately provided stabilizer-containing heat transfer sheet may be used to transfer the stabilizer according to a transfer pattern similar to that of the dye. Most preferably, stabilizer layers are formed in parallel with the dye layers of heat transfer sheets. For instance, for a color heat transfer sheet in which three or four colors, e.g. yellow, magenta and cyan or plus black, are successively formed on a substrate sheet, the stabilizer layers are formed in addition to such dye layers. After the transfer of the dyes, the stabilizer may subsequently be transferred onto an imaging region.

As means for applying heat energy used for carrying out heat transfer according to the process of this invention, all applicator means so far known in the art may be used. For instance, the desired image may be obtained by applying a heat energy of about 5–100 mJ/mm$^2$ for a controlled time with recording hardware such as a thermal printer (e.g., Video Printer VY-100 made by Hitachi, Ltd.).

According to the process of this invention wherein a color image is formed by repeating a plurality of heat transfer cycles, as above mentioned, it is possible to obtain a color image excellent in light fastness and resistance to fading in the dark by allowing a dye stabilizer to be included in or on the dye layer alone to be finally used and transferring the stabilizer onto an imaging region simultaneously with or after the transfer of the final dye.

Studies of the inventors have indicated that an effect obtained by adding an amount of the stabilizer to the final dye layer is nearly similar to that obtained when the same amount of the stabilizer has been added to each of all the dye layers. Hence, the amount of the stabilizer to be used is reduced to ½ to ¼ as a whole. This also helps eliminate another problem with using the stabilizer in too large an amount, e.g. a blurry hue of the resulting image.

The present invention will now be explained more illustratively with reference to the examples and comparative examples wherein, unless otherwise stated, the "parts" and "%" are given by weight.

EXAMPLE A1

Used as a substrate film was a 9-μm thick polyethylene terephthalate film (S-PE made by Toyobo Co., Ltd.) subjected on its backside or its surface which is not to be formed with dye layers to a heat-resistant treatment. Then, the substrate film was coated on its front surface with the following dye layer-forming Ink A to a dry coverage of 0.5 g/m$^2$ by means of a Miya bar #8, which was in turn dried into a first dye layer. Subsequently, the following Ink B was coated and dried on the first layer in a like manner to form a second dye layer of 0.5 μm in thickness. In this way, a heat transfer sheet according to this invention was prepared, in which the second dye layer of Ink B constituted the outer surface of the heat transfer sheet.

| | |
|---|---|
| Ink A | |
| Disperse dye - Kayaset Blue 136 (made by Nippon Kayaku K.K.) | 5 parts |
| Polyvinyl butyral resin - Eslec BX-1 made by Sekisui Chemical Co., Ltd.) | 5 parts |
| Methyl ethyl ketone | 30 parts |
| Toluene | 30 parts |
| Ink B | |
| Disperse dye - Kayaset Blue 136 (made by Nippon Kayaku K.K.) | 5 parts |
| Releasant - US-350 made by Toa Gosei K.K. | 0.5 parts |
| Polyvinyl butyral resin - Eslec BX-1 made by Sekisui Chemical Co., Ltd.) | 5 parts |
| Methyl ethyl ketone | 30 parts |
| Toluene | 30 parts |

EXAMPLE A2

The procedures of Example A1 were followed with the exception that in place of the releasant in Ink B, the same amount of another releasant (fluorine-modified silicone resin—FL100 made by The Shin-Etsu Chemical Co., Ltd.) was used, thereby preparing a heat transfer sheet according to this invention.

EXAMPLE A3

The procedures of Example A1 were followed with the exception that in place of the releasant in Ink B, 0.3 parts of another releasant (MF8F made by Astor Wax Co., Ltd., U.S.A.) was used, thereby preparing a heat transfer sheet according to this invention.

EXAMPLE A4

Ink B of Example A1 was changed to the following one, thereby obtaining a heat transfer sheet according to this invention.

| | |
|---|---|
| Silicone-grafted acetoacetal resin | 5 parts |
| Disperse dye - Kayaset Blue 136 (made by Nippon Kayaku K.K.) | 5 parts |
| Methyl ethyl ketone | 30 parts |
| Toluene | 30 parts |

Comparative Example A1

Only Ink A in Example A1 was used to form a 1.0-μm thick dye layer, with which a comparative heat transfer sheet was in turn prepared in like a manner.

Comparative Example A2

Only Ink B in Example A1 was used to form a 1.0-μm thick dye layer, with which a comparative heat transfer sheet was in turn prepared in like manner.

There was a difference in appearance between the dye layers of the heat transfer sheets according to Examples A1–4 and Comparative Example A1. The heat transfer sheets according to Examples A1–4 were uniform in appearance and color, but that of Comparative Example 2 was not.

A synthetic paper (Yupo FPB150 made by Oji Yuka K. K.) as a substrate film was coated on one surface with the following coating solutions A or B to a dry coverage of 4.5 g/m$^2$. Subsequent 30-minute drying at 100° C. gave two image-receiving sheets to be used in this invention and for the purpose of comparison.

| | |
|---|---|
| Coating Solution A | |
| Vinyl chloride-vinyl acetate copolymer - #1000A made by Denki Kagaku Kogyo K.K. | 20 parts |
| Methyl ethyl ketone | 40 parts |
| Toluene | 40 parts |
| Coating Solution B | |
| Vinyl chloride-vinyl acetate copolymer - #1000A made by Denki Kagaku Kogyo K.K. | 20 parts |
| Amino-modified silicone oil - KF393 made by The Shin-Etsu Chemical Co., Ltd. | 0.2 parts |
| Epoxy-modified silicone oil - X-22-343 made by The Shin-Etsu Chemical Co., Ltd. | 0.2 parts |
| Methyl ethyl ketone | 40 parts |
| Toluene | 40 parts |

A further image-receiving sheet was obtained by laminating a 100-μm thick white PET (E-20 made by Toray Industries, Inc.) on a vinyl chloride sheet (C-8133 made by Mitsubishi Jushi K. K.) in such a way that it was releasable after printing.

A card-like image-receiving sheet was obtained by laminating together a vinyl chloride sheet (card)— C-8133 (0.1 m/m), C-4291 (0.28 m/m) and C-4291 (0.28 m/m), all made by Mitsubishi Jushi K. K., with the use of a hot pressing machine and cutting the laminate into a desired size.

Heat Transfer Testing

Each of the heat transfer sheets according to the examples and comparative examples was overlaid on each of the image-receiving sheets, while the former's dye layer was opposite to the latter's image-receiving layer. Recording was then carried out from the backsides of the heat transfer sheets with thermal heads—KMT-85-6 and MPD2 under the following conditions:

Applied head voltage: 12.0 V;

Applied pulse width which decreased decrementally from 16.0 msec./line every 1 msec. according to a stepwise pattern; and Sub-scanning direction of 6 lines/mm (33.3 msec./line).

As a result, the heat transfer sheets according to the examples were all unlikely that the dye layers might migrate immediately onto the image-receiving layers during printing, and were well released from the image-receiving sheets after printing. Also, the resulting image representations developed clear colors.

By contrast, the heat transfer sheet of Comparative Example A1 suffered locally from the so-called unusual transfer through which the dye layer was transferred as such onto the image-receiving sheet, failing to give any satisfactory image.

EXAMPLE A5

The procedures of Example A1 were followed with the exception that in place of the releasant in Ink B, the releasants referred to in Table 1 were used, thereby obtaining heat transfer sheets according to this invention. They were then subjected to similar heat transfer tests to determine their releasability during printing. The results are reported in Table 1.

TABLE 1

| Releasant | Makers | Product Nos. | Releasability |
|---|---|---|---|
| Silicone alkyd | The Shin-Etsu Chemical Co., Ltd. | KP-5206 | ○ |
| Silicone grafted polymer | Toa Gosei K.K. | GS-30 | ○ |
| Silicone grafted polymer | Toa Gosei K.K. | US-3000 | ○ |
| Na salt of phosphoric ester | Toho Chemical Co., Ltd. | Gafak RE410 | ○ |
| Phosphoric ester | Ajinomoto Co., Ltd. | Lecithin | ○ |
| Alkyl-modified silicone | The Shin-Etsu-Chemical Co., Ltd. | KF412 | ○ |
| Fluorine fatty acid-modified silicone | The Shin-Etsu Chemical Co., Ltd. | SO-50450S | ○ |
| Phenyl group-containing silicone | The Shin-Etsu Chemical Co., Ltd. | KP-328 | ○ |
| Fatty acid-modified silicone | The Shin-Etsu Chemical Co., Ltd. | TA-6830 | ○ |
| Polyether-modified silicone | The Shin-Etsu Chemical Co., Ltd. | KF-352 | ○ |

Note) ○: good, x: bad

The second aspect of this invention will now be explained more illustratively with reference to the examples and comparative examples wherein, unless otherwise stated, the "parts" and "%" are given by weight.

Reference Example 1

Used as a substrate film was a synthetic paper of 150 μm in thickness (Yupo FRG-150 made by Oji Yuka K. K.). It was coated on one surface with a coating solution composed of the following components to a dry coverage of 5.0 g/m$^2$ with the use of a bar coater, immediately followed by pre-drying with a dryer and then 5-minute drying at 80° C. in an oven. In this way, a heat transfer sheet was obtained.

| | |
|---|---|
| Polyester resin (Vylon 600 made by Toyobo Co., Ltd.) | 4.0 parts |
| Vinyl chloride-vinyl acetate copolymer (#1000A made by Denki Kagaku K.K. | 6.0 parts |
| Amino-modified silicone oil - X-22-3050C made by The Shin-Etsu Chemical Co., Ltd. | 0.2 parts |
| Epoxy-modified silicone oil - X-22-3000E made by The Shin-Etsu Chemical Co., Ltd. | 0.2 parts |
| Methyl ethyl ketone at a 1:1 weight ratio | 89.6 parts |

Reference Example 2

Three-color dye-layer forming ink compositions made up of the following components were prepared.

| | |
|---|---|
| (Stabilizer-free) Yellow | |
| Disperse dye (Macrolex Yellow 6G - C.I. Disperse Yellow 201 made by Bayer Co., Ltd.) | 5.5 parts |
| Polyvinyl butyral resin - Eslec BX-1 made by Sekisui Chemical Co., Ltd. | 4.5 parts |
| Methyl ethyl ketone at a 1:1 weight ratio | 90.0 parts |
| (Stabilizer-free) Magenta | |
| Disperse dye (Macrolex Red Violet R - C.I. Disperse Violet 26 made by Bayer Co., Ltd.) | 5.5 parts |
| Polyvinyl butyral resin - Eslec BX-1 made by Sekisui Chemical Co., Ltd. | 4.5 parts |
| Methyl ethyl ketone at a 1:1 weight ratio | 90.0 parts |
| (Stabilizer-free) cyan | |
| Disperse dye - Foron Brilliant Blue S-R made by Sand Co., Ltd.) | 3.0 parts |
| Polyvinyl butyral resin - Eslec BX-1 made by Sekisui Chemical Co., Ltd. | 5.0 parts |
| Methyl ethyl ketone at a 1:1 weight ratio | 92.0 parts |
| (Stabilizer-free) Black | |
| Disperse dye (Macrolex Yellow 6G - C.I. Disperse Yellow 201 made by Bayer Co., Ltd.) | 2.5 parts |
| Disperse dye (Macrolex Red Violet R - C.I. Disperse Violet 26 made by Bayer Co., Ltd.) | 2.5 parts |
| Disperse dye - Foron Brilliant Blue S-R made by Sand Co., Ltd.) | 2.0 parts |
| Polyvinyl butyral resin - Eslec BX-1 made by Sekisui Chemical Co., Ltd. | 5.0 parts |
| Methyl ethyl ketone at a 1:1 weight ratio | 88.0 parts |
| (Stabilizer-containing) Yellow | |
| Disperse dye (Macrolex Yellow 6G - C.I. Disperse Yellow 201 made by Bayer Co., Ltd.) | 5.5 parts |
| Ultraviolet absorber - Tinuvin P made by Ciba Geigy AG | 2.0 parts |
| Polyvinyl butyral resin - Eslec BX-1 made by Sekisui Chemical Co., Ltd. | 4.5 parts |
| Methyl ethyl ketone at a 1:1 weight ratio | 88.0 parts |
| (Stabilizer-containing) Magenta | |
| Disperse dye (Macrolex Red Violet R - C.I. Disperse Violet 26 made by Bayer Co., Ltd.) | 5.5 parts |
| Ultraviolet absorber - Tinuvin P made by Ciba Geigy AG | 2.0 parts |
| Polyvinyl butyral resin - Eslec BX-1 made by Sekisui Chemical Co., Ltd. | 4.5 parts |
| Methyl ethyl ketone at a 1:1 weight ratio | 88.0 parts |
| (Stabilizer-containing) Cyan | |
| Disperse dye - Foron Brilliant Blue S-R made by Sand Co., Ltd.) | 3.0 parts |
| Ultraviolet absorber - Tinuvin P made by Ciba Geigy AG | 2.0 parts |
| Polyvinyl butyral resin - Eslec BX-1 made by Sekisui Chemical Co., Ltd. | 5.0 parts |
| Methyl ethyl ketone at a 1:1 weight ratio | 90.0 parts |
| (Stabilizer-free) Black | |

-continued

| | |
|---|---|
| Disperse dye (Macrolex Yellow 6G - C.I. Disperse Yellow 201 made by Bayer Co., Ltd.) | 2.5 parts |
| Disperse dye (Macrolex Red Violet R - C.I. Disperse Violet 26 made by Bayer Co., Ltd.) | 2.5 parts |
| Disperse dye - Foron Brilliant Blue S-R made by Sand Co., Ltd.) | 2.0 parts |
| Ultraviolet absorber - Tinuvin P made by Ciba Geigy AG | 2.0 parts |
| Polyvinyl butyral resin - Eslec BX-1 made by Sekisui Chemical Co., Ltd. | 5.0 parts |
| Methyl ethyl ketone at a 1:1 weight ratio | 86.0 parts |

EXAMPLE B1

Each of the aforesaid ink compositions was coated on one surface of a 4.5-μm thick polyethylene terephthalate film (Lumirror 5AF53 made by Toray Industries, Inc.) having the other surface subjected to a heat-resistant treatment to a dry coverage of 1.0 g/m$^2$ by means of a wire bar coater, immediately followed by pre-drying with a dryer and then 5-minute drying at 80° C. ion an oven. In this way, 8 heat transfer sheets were obtained.

Each of the thus obtained heat transfer sheets was overlaid on a heat transfer image-receiving sheet, while the former's dye layer was opposite to the latter's image-receiving layer). Using a thermal sublimation type of heat transfer printer—VY-100 made by Hitachi, Ltd., printing was carried from the backside of the heat transfer sheet through the thermal head with a printing energy of 90 mJ/mm$^2$ in the following transfer order, thereby forming a color image. The results are reported in Table 2.

a: yellow→magenta→cyan→black* b: yellow→magenta→cyan* c: yellow→magenta* d: yellow→cyan* e: magenta→cyan*

It is noted that the dyes with an asterisk contained a stabilizer, but the dyes with no asterisk did not.

Comparative Example B1

According to the procedures of Example B1, color images were formed in the following printing order and was then similarly estimated. The results are reported in Table 2.

a: yellow→magenta→cyan→black b: yellow→magenta→cyan c: yellow→magenta d: yellow→cyan e: magenta→cyan It is noted that the dyes with an asterisk contained a stabilizer, but the dyes with no asterisk did not.

Comparative Example B2

According to the procedures of Example B1, color images were formed in the following printing order and was then similarly estimated. The results are reported in Table 2.

a: yellow*→magenta*→cyan*→black* b: yellow*→magenta*→cyan* c: yellow*→magenta* d: yellow*→cyan* e: magenta*→cyan*

It is noted that the dyes with an asterisk contained a stabilizer, but the dyes with no asterisk did not.

Comparative Example B3

According to the procedures of Example B1, color images were formed in the following printing order and was then similarly estimated. The results are reported in Table 2.

a: yellow*→magenta*→cyan*→black b: yellow*→magenta*→cyan c: yellow*→magenta* d: yellow*→cyan e: magenta*→cyan

It is noted that the dyes with an asterisk contained a stabilizer, but the dyes with no asterisk did not.

EXAMPLE B2

In place of the ultraviolet absorber in each of the four-color dye ink compositions of Reference Example 2, the same amount of an antioxidant—Sumilizer BBM-S was used to form a four-color heat transfer sheet. This was in turn used in combination with the stabilizer-free heat transfer sheet according to Reference Example 2 to form a color image according to the procedures of Example B1 in the following order, which was similarly estimated. The results are reported in Table 2.

a: yellow→magenta→cyan→black b: yellow→magenta→cyan* c: yellow→magenta* d: yellow→cyan* e: magenta→cyan*

It is noted that the dyes with an asterisk contained a stabilizer, but the dyes with no asterisk did not.

Comparative Example B4

Estimation was made of the resistance to fading in dark places of the same color images a to e as those of Comparative Example B1.

TABLE 2

| | Fading Factor % (upon exposed to light) | | |
|---|---|---|---|
| Example Nos. | Yellow | Magenta | Cyan |
| Ex. B1-a | 6% | 5% | 15% |
| Ex. B1-b | 4% | 5% | 12% |
| Ex. B1-c | 3% | 7% | — |
| Ex. B1-d | 4% | — | 14% |
| Ex. B1-e | — | 3% | 10% |
| Comp. Ex. B1-a | 16% | 11% | 27% |
| Comp. Ex. B1-b | 12% | 8% | 23% |
| Comp. Ex. B1-c | 8% | 13% | — |
| Comp. Ex. B1-d | 7% | — | 25% |
| Comp. Ex. B1-e | — | 7% | 18% |
| Comp. Ex. B2-a | 5% | 5% | 14% |
| Comp. Ex. B2-b | 6% | 5% | 15% |
| Comp. Ex. B2-c | 4% | 6% | — |
| Comp. Ex. B2-d | 6% | — | 17% |
| Comp. Ex. B2-e | — | 3% | 11% |
| Comp. Ex. B3-a | 11% | 9% | 23% |
| Comp. Ex. B3-b | 10% | 7% | 19% |
| Comp. Ex. B3-c | 6% | 11% | — |
| Comp. Ex. B3-d | 7% | — | 22% |
| Comp. Ex. B3-e | — | 6% | 17% |
| Ex. B2-a | 5% | 6% | 11% |
| Ex. B2-a | 4% | 4% | 9% |
| Ex. B2-a | 6% | 4% | — |

TABLE 2-continued

| Example Nos. | Fading Factor % (upon exposed to light) Yellow | Magenta | Cyan |
|---|---|---|---|
| Ex. B2-a | 4% | — | 13% |
| Ex. B2-a | — | 3% | 10% |
| Comp. Ex. B4-a | 10% [001b] | 9% | 23% |
| Comp. Ex. B4-b | 9% | 6% | 20% |
| Comp. Ex. B4-c | 11% | 8% | — |
| Comp. Ex. B4-d | 8% | — | 25% |
| Comp. Ex. B4-e | — | 7% | 20% |

It is understood that the fading factor of prints upon exposure to light was determined according to the exposure conditions provided in JIS 4 class standards, and that the fading factor of prints in dark places was determined by comparison with that of prints after dry left at 70° C. for 24 hours. The respective fading factors are found by:

$$\text{Fading factor (\%)} = \frac{O.D._0 - O.D._1}{O.D._0} \times 100\ (\%)$$

wherein $O.D._0$=the density of light reflected off prints just after printing, and $O.D._1$=the density of light reflected off prints after testing.

EXAMPLE B3

According to the procedures of Reference Example 2, dye layers were successively formed on the same substrate film in the following order to obtain a heat transfer sheet according to this invention. This sheet was used to form a color image in a similar manner as mentioned in Ex. B1, which was in turn similarly estimated. The results obtained were found to be similar to those of Ex. B1.

a: yellow→magenta→cyan→black* b: yellow→magenta→cyan* c: yellow→magenta* d: yellow→cyan*

It is noted that the dyes with an asterisk contained a stabilizer, but the-dyes with no asterisk did not.

EXAMPLE B4

The procedures of Ex. B3-b were followed with the exception that instead of adding the stabilizer to the cyan dye layer, a stabilizer-free cyan dye layer was formed and the following composition was further coated and dried on its one surface to a dry coverage of 1.0 g/m$^2$, thereby obtaining a heat transfer sheet according to this invention. According to the procedures of Ex. B1 a color image was formed and then estimated. The results obtained were found to be similar to those of Ex. B1.

| Stabilizer | |
|---|---|
| Polyvinyl butyral resin - Eslec BX-1 made by Sekisui Chemical Co., Ltd. | 6.0 parts |
| UV absorber - Tinuvin P | 4.0 parts |
| Methyl ethyl ketone at a 1:1 weight ratio | 90.0 parts |

EXAMPLE B5

The procedures of Ex. B3-b were followed with the exception that instead of adding the stabilizer to the cyan dye layer, a stabilizer-free cyan dye layer was formed and the same composition as used in Ex. B4 was further coated and dried adjacent to it to a dry coverage of 1.0 g/m$^2$, thereby forming a stabilizer layer. The thus obtained heat transfer sheet according to this invention was used to form an image in similar manners as referred to in Ex. B1. Then, the stabilizer was transferred onto the image for similar estimation. The results obtained were found to be similar to those of Ex. B1.

EXAMPLE B6

Instead of the UV absorber or antioxidant used in Example B1 or B2, the following antioxidants, UV absorbers and light stabilizer were used:

Sumilizer BHT, Sumilizer GM, Sumilizer MB and Sumilizer TPP-R;

Yoshinox 425 and Yoshinox SR;

Irganox-1081 and Irganox-1222;

Mark AO-40;

Tinuvin 234, Tinuvin 320, Tinuvin 326, Tinuvin 327 and Tinuvin 327;

Sumisorb 110 and Sumisorb 140;

Kemisorb 10, Kemisorb 11, Kemisorb 12 and Kemisorb 13;

Uvinul X-19 and Uvinul Ms-40;

Tomisorb 100 and Tomisorb 600;

Viosorb-80 and Viosorb-90;

Sanol LS-700, Sanol LS-765 and Sanol LS-774; and

Sumisorb TM-061.

Examples B1 or B2 was otherwise repeated to obtain images, which were found to excel in light fastness and resistance to fading in dark places.

What is claimed is:

1. A heat transfer assemblage for thermal transfer recording using at least one thermal head, said assemblage comprising (a) a heat transfer sheet and (b) an image-receiving card comprising a dyeable vinyl chloride resin and having no dye-receiving layer on a surface thereof, said heat transfer sheet comprising:

a substrate film; and a dye layer system formed on said substrate film, said dye layer system comprising two layers, only the outer surface layer of which contains an additive comprising a silicone graft acetoacetal resin, said dye layer system comprising a binder and substantially the same amount of dye in each of said two layers, wherein said dye is allowed to migrate and transfer thermally onto the surface of said image-receiving card.

2. The heat transfer assemblage of claim 1, wherein said additive is present in an amount of 0.1% by weight to 30% by weight of said outer surface layer.

3. The heat transfer assemblage of claim 1, wherein said image-receiving card further comprises at least one of polycarbonate resin and ABS resin.

4. A heat transfer assemblage for thermal transfer recording using at least one thermal head, said assemblage comprising (a) a heat transfer sheet and (b) an image-receiving card comprising a dyeable vinyl chloride resin and having no dye-receiving layer on a surface thereof, said heat transfer sheet comprising:

a substrate film; and a dye layer system formed on said substrate film, said dye layer system comprising two layers, only the outer surface layer of which contains a binder comprising a silicone graft acetoacetal resin, said dye layer system comprising a binder and substantially the same amount of dye in each of said two layers, wherein said dye is allowed to migrate and transfer thermally onto the surface of said image-receiving card.

5. The heat transfer assemblage of claim 4, wherein said image-receiving sheet further comprises at least one of polycarbonate resin and ABS resin.

6. A method for thermal recording comprising:

providing (a) a heat transfer sheet and (b) an image-receiving card comprising a dyeable vinyl chloride resin and having no dye-receiving layer on a surface thereof, said heat transfer sheet comprising a substrate film, and a dye layer system formed on said substrate film, said dye layer system comprising two layers, only the outer surface layer of which contains an additive comprising a silicone graft acetoacetal resin, said dye layer system comprising a binder and substantially the same amount of dye in each of said two layers, wherein said dye is allowed to migrate and transfer thermally onto the surface of said image-receiving card;

bringing said dye layer system of said heat transfer sheet into direct contact with the surface of said image-receiving card; and applying thermal energy to a back side of said substrate film of said heat transfer sheet using at least one thermal head to carry out thermal recording directly on the surface of said image-receiving card.

7. The method of claim 6, wherein said additive is present in an amount of 0.1% by weight to 30% by weight of said outer surface layer.

8. The method of claim 6, wherein said image-receiving card further comprises at least one of polycarbonate resin and ABS resin.

9. A method for thermal recording comprising:

providing (a) heat transfer sheet and (b) an image-receiving card comprising a dyeable vinyl chloride resin and having no dye-receiving layer on a surface thereof, said heat transfer sheet comprising a substrate film, and a dye layer system formed on said substrate film, said dye layer system comprising two layers, only the outer surface layer of which contains a binder comprising a silicone graft acetoacetal resin, said dye layer system comprising a binder and substantially the same amount of dye in each of said two layers, wherein said dye is allowed to migrate and transfer thermally onto the surface of said image-receiving card;

bringing said dye layer system of said heat transfer sheet into direct contact with the surface of said image-receiving card; and applying thermal energy to a back side of said substrate film of said heat transfer sheet using at least one thermal head to carry out thermal recording directly on the surface of said image-receiving card.

10. The method of claim 9, wherein said image-receiving card further comprises at least one of polycarbonate resin and ABS resin.

* * * * *